US007857083B2

(12) United States Patent
Oyamada et al.

(10) Patent No.: US 7,857,083 B2
(45) Date of Patent: Dec. 28, 2010

(54) EXCAVATION MACHINE

(75) Inventors: Yasuyuki Oyamada, Chikugo (JP); Keiichi Nishihara, Chikugo (JP); Takahiro Ikeda, Chikugo (JP); Takafumi Nobayashi, Chikugo (JP); Masao Nagata, Chikugo (JP); Saizou Kondou, Chikugo (JP); Masami Miyanishi, Chikugo (JP)

(73) Assignee: Yanmar Co., Ltd., Osaka-shi (JP)

( * ) Notice: Subject to any disclaimer, the term of this patent is extended or adjusted under 35 U.S.C. 154(b) by 94 days.

(21) Appl. No.: 12/282,833

(22) PCT Filed: Aug. 25, 2006

(86) PCT No.: PCT/JP2006/316718

§ 371 (c)(1),
(2), (4) Date: Oct. 27, 2008

(87) PCT Pub. No.: WO2007/105326

PCT Pub. Date: Sep. 20, 2007

(65) Prior Publication Data

US 2009/0104011 A1 Apr. 23, 2009

(30) Foreign Application Priority Data

Mar. 13, 2006 (JP) ..... 2006-067817

(51) Int. Cl.
*B62D 33/00* (2006.01)
*B62D 25/20* (2006.01)

(52) U.S. Cl. ..... 180/89.1; 180/69.1; 180/89.19; 180/311; 180/312

(58) Field of Classification Search ..... 180/69.1, 180/89.1, 89.19, 311, 312
See application file for complete search history.

(56) References Cited

U.S. PATENT DOCUMENTS 4,322,107 A * 3/1982 Ishizuka et al. ..... 296/146.11

(Continued)

FOREIGN PATENT DOCUMENTS

JP 56-105558 8/1981

(Continued)

OTHER PUBLICATIONS

International Search Report for Application No. PCT/JP2006/316718, Japanese Patent Office, mailed Sep. 19, 2006, 2 pgs.

(Continued)

*Primary Examiner*—Toan C To
*Assistant Examiner*—Barry Gooden, Jr.
(74) *Attorney, Agent, or Firm*—Sterne, Kessler, Goldstein & Fox P.L.L.C.

(57) ABSTRACT

An objective of the present invention is to provide a counterweight of a power shovel interchangeable with that of a superordinate model without affecting a rear end radius of the shovel at the time of rotation. In the power shovel 50 in which the counterweight is formed at the rear part of a vehicle body frame 11 extended from a front end to a rear end of a lower part of a rotation upper body 10, and an engine 14 is mounted on the rear part of the vehicle body frame 11, an additional weight 12 is placed in a space between the rear part of the vehicle body frame 11 and the engine 14.

3 Claims, 5 Drawing Sheets

U.S. PATENT DOCUMENTS

| | | | | |
|---|---|---|---|---|
| 4,711,467 | A * | 12/1987 | Link et al. | 280/785 |
| 6,745,860 | B2 * | 6/2004 | Yabe | 180/68.1 |
| 7,162,816 | B2 * | 1/2007 | Otsuka et al. | 37/347 |
| 7,388,301 | B2 * | 6/2008 | Komiyama et al. | 290/40 C |
| 2001/0007292 | A1 * | 7/2001 | Yabf | 180/68.1 |
| 2002/0040820 | A1 * | 4/2002 | Takano et al. | 180/89.19 |
| 2003/0070860 | A1 * | 4/2003 | Gotz | 180/311 |
| 2004/0245037 | A1 * | 12/2004 | Aoyama et al. | 180/312 |

FOREIGN PATENT DOCUMENTS

| | | |
|---|---|---|
| JP | 2003-41626 | 2/2003 |
| JP | 2004-116097 | 4/2004 |

OTHER PUBLICATIONS

Patent Abstracts of Japan, English language abstract for Publication No. JP 2003-041626, Slewing Construction Machinery, published Feb. 13, 2003 (listed on accompanying PTO/SB/08A as document FP2).

Patent Abstracts of Japan, English language abstract for Publication No. JP 2004-116097, Construction Machinery, published Apr. 15, 2004 (listed on accompanying PTO/SB/08A as document FP3).

* cited by examiner

EXCAVATION MACHINE

FIELD OF THE INVENTION

The present invention relates to a structural technique of a counterweight provided at a rear part of a vehicle body for keeping a balance at the time of a work in an excavation machine represented by a power shovel or the like.

BACKGROUND ART

A power shovel is well known as an excavation machine capable of excavating and loading earth and sand. Generally, a power shovel generates hydraulic pressure by a hydraulic pressure pump driven by a diesel engine so as to carry out all the operation of a run and a work. Further, a crawler type travel gear is widely used as a travel gear. As for a basic structure of a power shovel, the power shovel includes a self-propelling lower traveling body and an upper rotation body capable of rotating 360 degrees on the lower traveling body. When the upper rotation body faces toward a running direction, a driver seat and a working device are provided at a front section of the upper rotation body, and a power source such as an engine or the like is provided at the rear section thereof.

In order to improve a balance at the time of working, a power shovel includes a weight called a counterweight at the rear part of the upper rotation body (for example, Patent Document 1). Conventionally, a technique that a counterweight has a detachable structure capable of being attached/detached according to a necessity is also publicly known. Further, a counterweight integrated with a vehicle body frame, and the like is also used.

Patent Document 1: Japanese Patent No. 3732480

DISCLOSURE OF THE INVENTION

Problem to be Solved by the Invention

When a counterweight is provided to a power shovel at a rear end part of a vehicle body frame of the upper rotation body or on a rear outer side of a vehicle body frame, a rear end radius becomes larger, so that the upper rotation body may not be stayed within a range allowing the protrusion. Further, in a case that a counterweight is integrated with a vehicle body frame, since a power shovel does not have interchangeability with that of a superordinate model which has, for example, a same rotation body but a long total length of a working machine, a vehicle body frame corresponding to the model is needed. Thus, the number of required parts in the vehicle body frame is increased.

Therefore, an objective to be solved is to provide a counterweight of a power shovel interchangeable with that of a superordinate model without affecting the rear end rotation radius of the shovel at the time of rotation.

Means Adapted to Solve the Problems

The problems to be solved by the present invention are as described above, and the means adapted to solve the problems will be described below.

That is, the present invention is to provide an excavation machine in which a counterweight is formed at a rear part of a vehicle body frame extended from a front end to a rear end of a lower part of an upper rotation body, and an engine is mounted on a floor part of the vehicle body frame, wherein an additional weight is placed in a space between the engine and inner faces of the rear part and the floor part of the vehicle body frame.

Further, in the present invention, the additional weight is formed in an L-shape in side view with a horizontal part and a vertical part, and an opening part which is capable of being inserted with an oil pan provided at a lower part of the engine is provided at a center of the horizontal part.

Furthermore, in the present invention, the additional weight is formed in an L-shape in side view with the horizontal part and the vertical part, and cutouts are formed on both sides of the front part of the horizontal part for avoiding an engine mount provided projecting on the vehicle body frame.

EFFECT OF THE INVENTION

The present invention has following effects.

In the present invention, the additional weight is placed in the space between the engine and the inner faces of the rear part and the floor part of the vehicle body frame. Thus, even though the weight is increased, a pivot radius of the upper rotation body at the time of rotation is still a pivot radius of a rear end of the vehicle body frame, and never become larger than that. Further, when the weight is needed to be increased, the increase of the weight can be compatible by only adding the additional weight while the vehicle body frame is maintained as it is. Thus, general purpose properties are improved.

Further, in addition to the afore-said effect, in the present invention, engine lubrication oil can be exchanged from outside since the opening part for inserting the oil pan of the engine is provided at the additional weight. That is, maintenance performance of the engine is improved. Further, when the engine is mounted on the additional weight, the engine can be mounted by fitting the oil pan into the opening part of the additional weight. Thus, the height of the engine can be made low.

Furthermore, in addition to the afore-said effect, in the present invention, since the additional weight is configured such that engine is not contacted with the additional weight by providing cutouts for avoiding the engine mount, heat or vibration of the engine is not transmitted to the additional weight when the engine is operated. That is, the safety of devices around the engine is improved.

REFERENCE NUMERALS

10: Upper rotation body
11: Vehicle body frame
12: Additional weight
14: Engine
50: Power shovel

BEST MODES FOR CARRYING OUT THE INVENTION

Next, the preferred embodiment of the present invention will be described.

Figure 1:
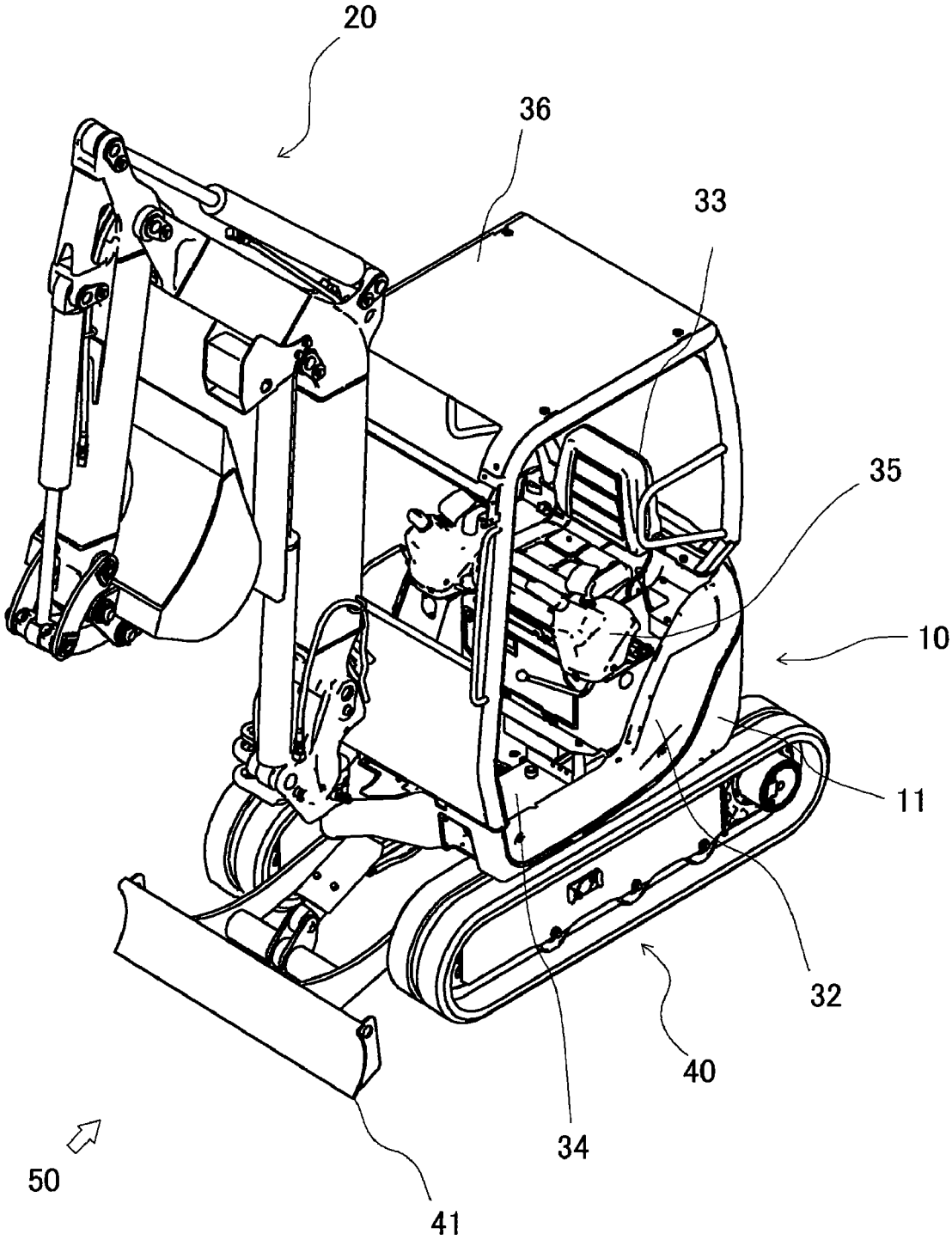
FIG. 1 is a perspective view to illustrate a whole configuration of a power shovel according to an example of the present invention.
Figure 2:
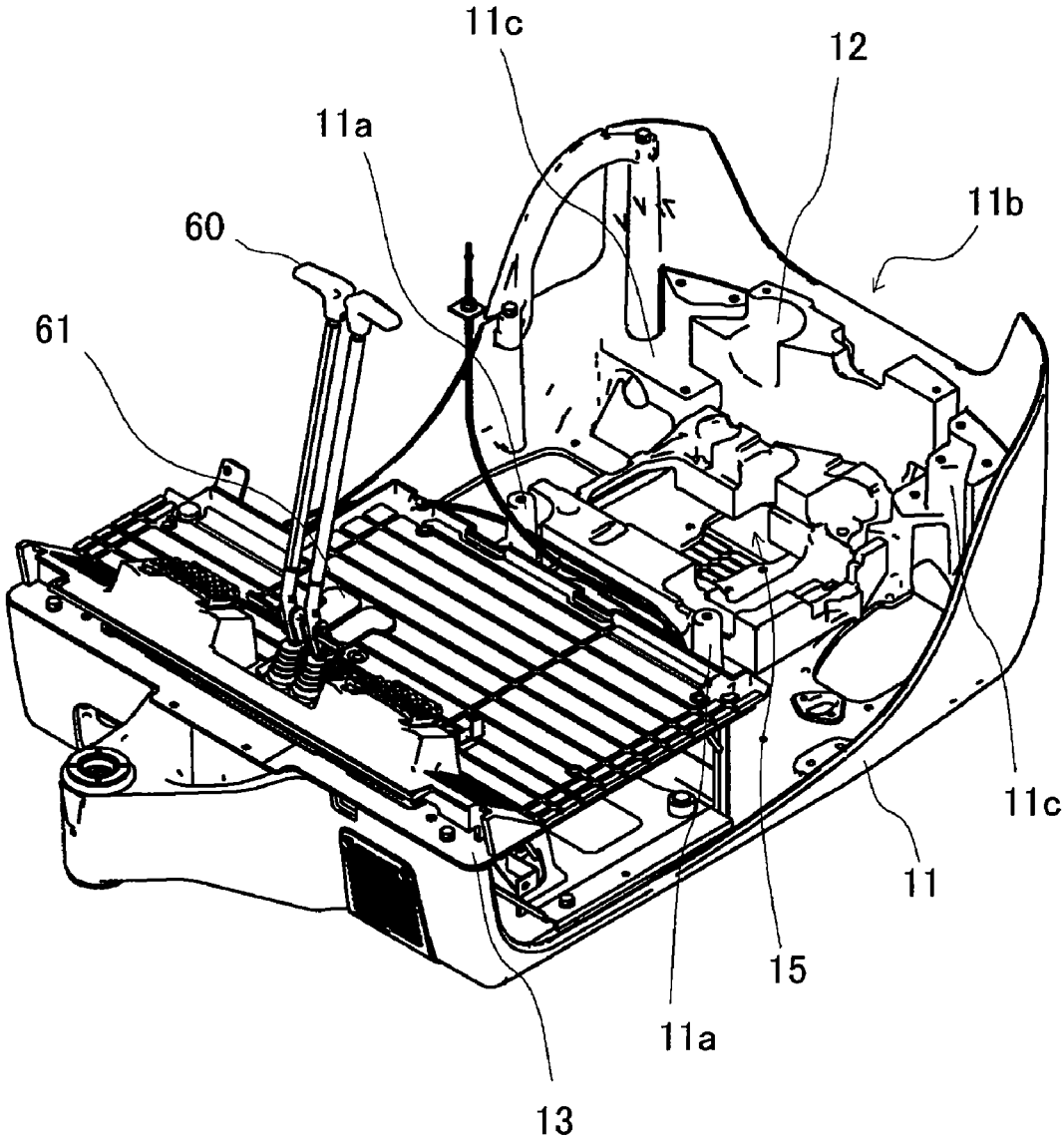
FIG. 2 is a perspective view to illustrate a state that an additional weight is mounted on a vehicle body frame.
Figure 3:
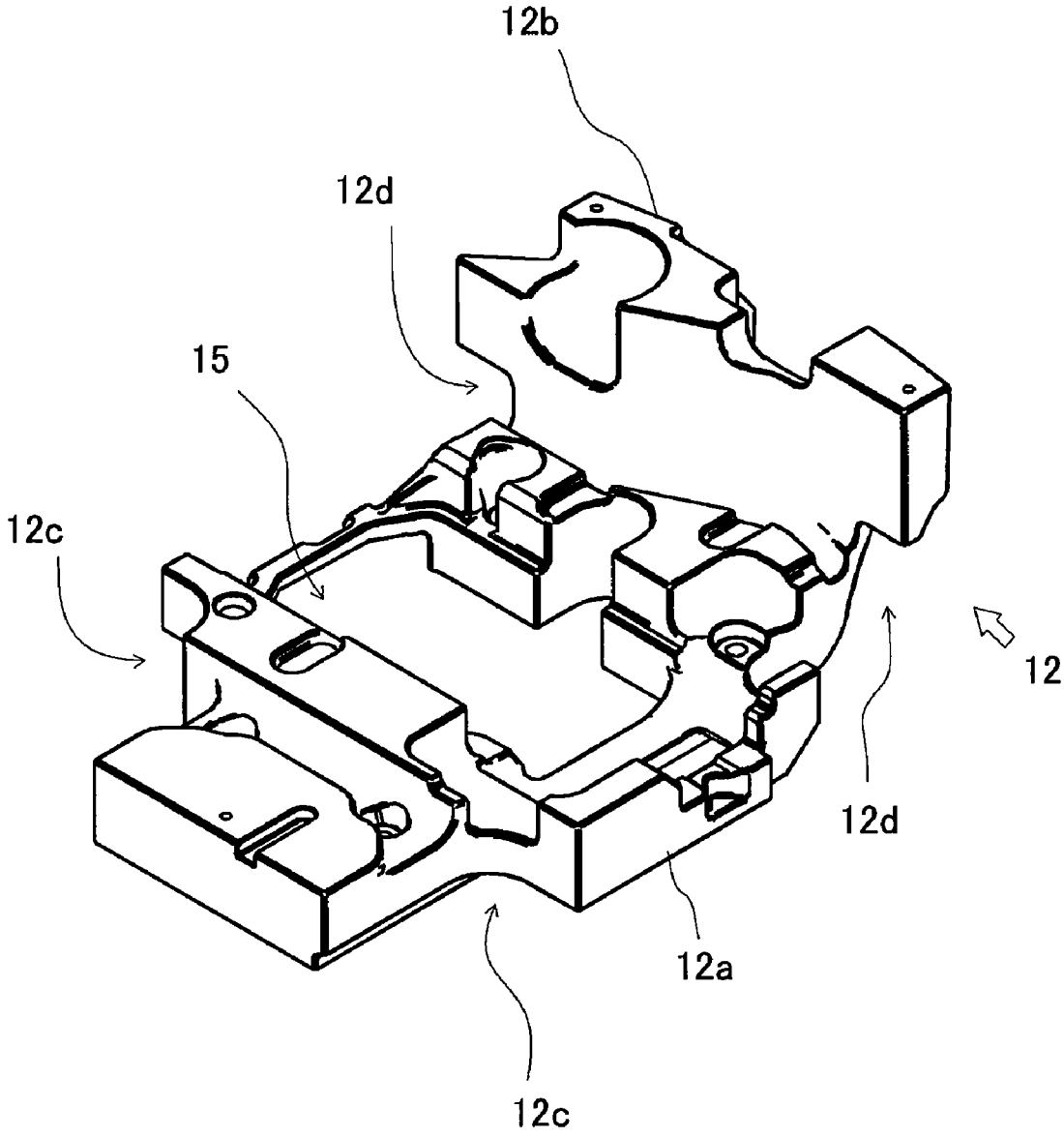
FIG. 3 is a perspective view to illustrate an additional weight.

FIG. 1 is a perspective view to illustrate the whole configuration of a power shovel according to an example of the present invention. FIG. 2 is a perspective view to illustrate a state that an additional weight is mounted on a vehicle body frame. FIG. 3 is a perspective view to illustrate an additional weight.

Figure 4:
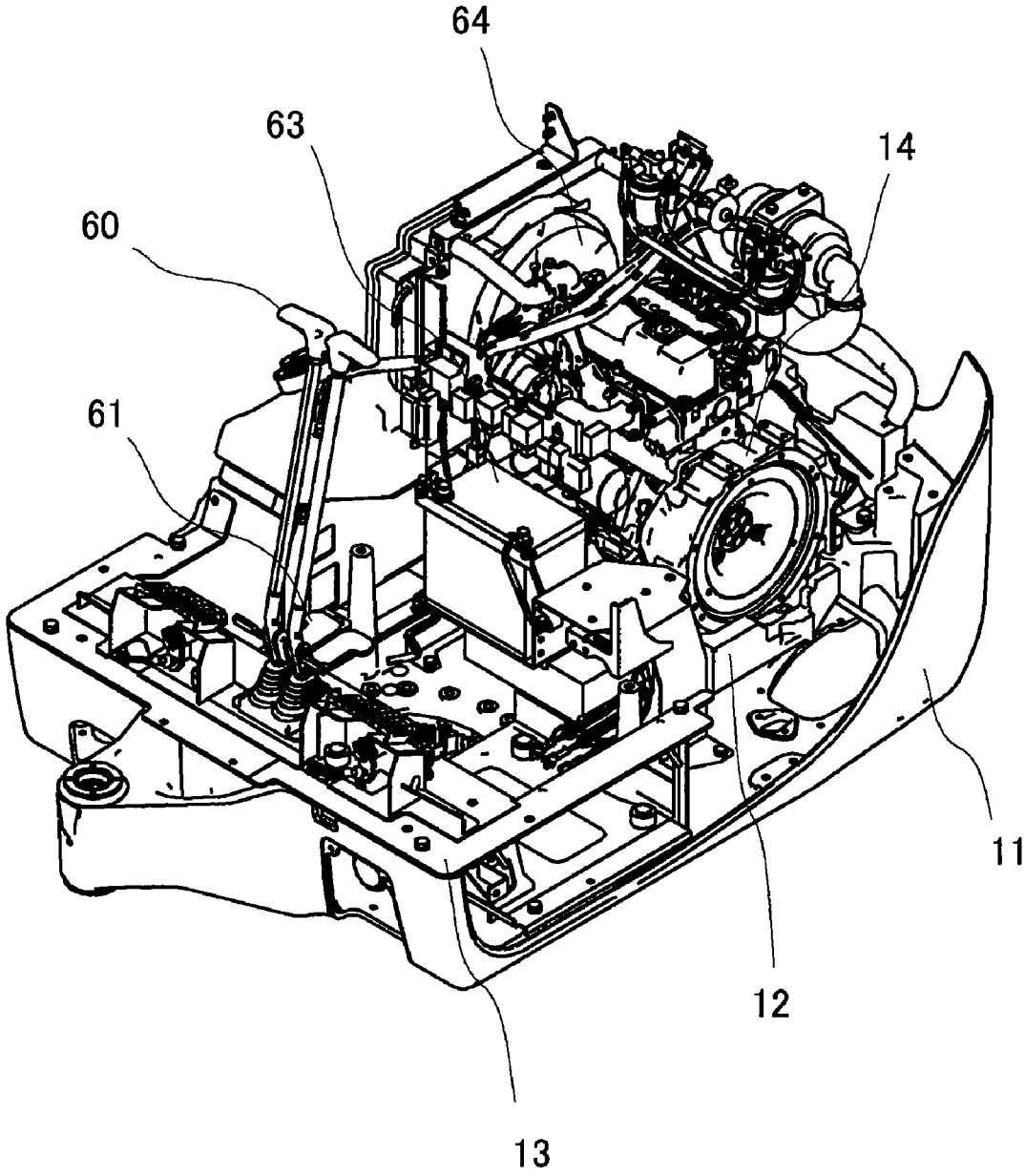
FIG. 4 is a perspective view to illustrate a state that an additional weight and an engine are mounted on a vehicle body frame.
Figure 5:
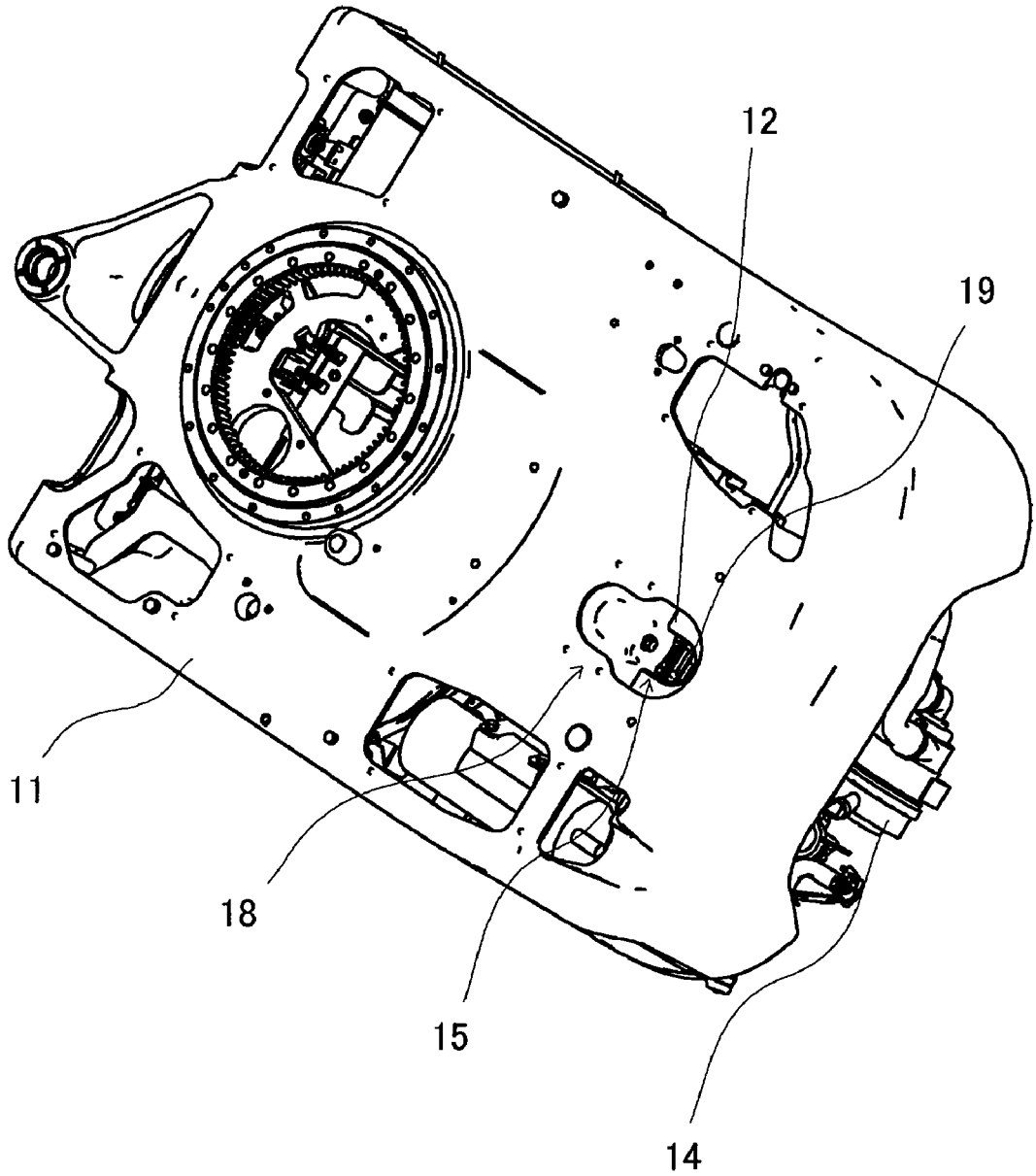
FIG. 5 is a perspective view to illustrate a bottom part of an upper rotation body.

FIG. 4 is a perspective view to illustrate a state that an additional weight and an engine are mounted on a vehicle body frame. FIG. 5 is a perspective view to illustrate a bottom part of an upper rotation body.

As illustrated in FIG. 1, a power shovel 50 which is well known as an excavation machine is an example of the present invention. The power shovel 50 is an excavation working machine for excavating earth, sand, and rocks as an excavation machine. The power shovel 50 is an excavation machine of a hydraulic type shovel which is most widely used. The power shovel 50 can carry out a loading operation along with excavation of earth and sand which is a main objective thereof.

As illustrated in FIG. 1, the power shovel 50 is generally constituted with a crawler type travel gear 40, an upper rotation body 10 clockwise and counterclockwise rotatably supported at the upper center of the crawler type travel gear 40, and a working machine 20 provided at lateral center part of the front part of the upper rotation body 10.

The crawler type travel gear 40 is arranged with a blade 41 which is vertically movably rotatable on one side of the front and rear thereof. The blade 41 is used at the time of a leveling work accompanying with an excavation. In addition, the crawler type travel gear 40 can use a variable gauge crawler and thus can ensure stability by increasing an interval of the crawler at the time of working.

In a lower part of the upper rotation body 10, a vehicle body frame is extended from a front end to a rear end of the rotation body 10 while keeping horizontally full width. A counterweight is integrally configured at a rear part of the vehicle body frame 11. An engine 14 (FIG. 4) is mounted on the rear upper section of the vehicle body frame 11. A rear section of the engine 14 is covered with a bonnet, which is not illustrated, and the vehicle body frame 11, and both sides of the engine 14 are covered with covers 32 and 32.

A driver seat 33 is provided between the covers 32 and 32 at an upper part of the engine. Further, a driving operation part 35 is configured by being arranged with a control lever, a lock lever, and the like near the driver seat 33, and a traveling lever 60 and a pedal 61 on a step 34 at a front part of the driver seat 33 (refer to FIG. 2). Furthermore, a canopy 36 is provided above the driving operation part 35, and a cabin is provided around the driving operation part 35.

The working machine 20 is generally configured with a boom, an arm, and a bucket. Each of these members is made to be rotatable by an extension/contraction drive of a cylinder to carry out an excavation operation and a loading operation.

FIG. 2 illustrates the upper rotation body 10 in which a support base for supporting the canopy 36, the cover 32, and the driver seat 33 are removed in order to simply illustrate an internal configuration of the upper rotation body 10. An equipment frame 13 is mounted on a front part of the vehicle body frame 11, and the additional weight 12 is mounted on a rear part of the vehicle body frame 11.

The vehicle body frame 11 is formed by casting or the like to have a recessed shape. The rear part and both sides of the rear part of the vehicle body frame 11 is made thicker and raised upwardly to make a counterweight. A support part for attaching a working machine (a boom bracket) is formed at the front part of the vehicle body frame 11. An opening part for inserting a swivel joint or the like is provided at an internal center of the vehicle body frame 11, and a support projection for attaching the equipment frame 13 or the like is upwardly projected at a front part of the opening part. A projection (a mount) for attaching the engine 14, a hydraulic pump, a hydraulic oil tank, and the like are upwardly projected at a rear section of the opening part.

Hydraulic equipments (not illustrated) such as control valve, a relief valve, and the like for switching a drive of the working machine 20 are housed inside between the equipment frame 13 and the vehicle body frame 11, and the traveling lever 60 and the pedal 61 for operating the hydraulic equipments are provided at an upper section of the equipment frame 13.

The counterweight is a weight to improve a balance at the time of an excavation by an excavation machine. Since the power shovel 50 is equipped with the working machine 20 at a front part thereof (refer to FIG. 1), a frontward displacement of gravity is prevented by providing the counterweight at a rear part of the power shovel 50. Further, when a large working machine is attached using the same vehicle body frame 11, more particularly, when a working machine having a longer arm or boom is attached, the additional weight 12 is provided.

Conventionally, an additional weight is attached to a rear face or a lower face of the vehicle body frame 11. When the additional weight is attached to the rear face of the vehicle body frame, there is a problem that a pivot radius becomes large. When the additional weight is attached to the lower face, there is a problem that the minimum ground clearance becomes high. Thus, in the present invention, the additional weight 12 is attached to the rear internal of the vehicle body frame 11.

As illustrated in FIG. 3, the additional weight 12 is formed in an L-shape in side view with a horizontal part 12*a* and a vertical part 12*b*, and a width in a lateral direction is made to be a size which can be housed in the vehicle body frame 11.

The horizontal part 12*a* is formed with an opening part 15 which penetrates through a center part thereof in a vertical direction. The opening part 15 is for avoiding the oil pan 19 (refer to FIG. 5) or an oil filter provided at the lower part of the engine 14, and has a size surrounding a circumference of the oil pan 19 and the oil filter. Further, cutouts 12*c* and 12*c* are formed on both sides of a front end of the horizontal part 12*a*, so that the additional weight 12 can be provided avoiding front mount parts 11*a* and 11*a* which are upwardly projected from an inside of the vehicle body frame 11 (refer to FIG. 2). By providing the cutouts 12*c* and 12*c*, the additional weight 12 can be further extended to a frontward space so as to increase weight. Furthermore, a recessed part 12*d* is formed on both sides of the rear horizontal part 12*a*, so that the additional weight 12 is placed avoiding the rear mount parts 11*c* and 11*c* of the engine 14 at the both sides of the recessed part 12*d* (refer to FIG. 2).

The vertical part 12*b* is arranged in a space between a rear face of the engine 14 and a rear inner face of the vehicle body frame 11.

Further, the additional weight 12 of this example is a cast part formed by integrally molding. The casting made by integrally molding can form a complicated shape. Furthermore, materials of the additional weight 12 is not restricted in this example, but a metal having a high density, which is called as a high-density alloy, is generally used.

FIG. 4 illustrates a state that the engine 14, a battery 63, and a radiator 64 are placed on the vehicle body frame 11 illustrated in FIG. 2.

As illustrated in FIG. 4, the additional weight 12 is placed in a space between the engine 14 and the vehicle body frame 11. The engine 14 is mounted on the vehicle body frame 11 via a vibration isolation member or the like, and a space having approximately a same height as that of the vibration isolation member is formed between the engine 14 and the vehicle body frame 11. A vertical thickness of the horizontal part 12*a* is determined so as to be slightly shorter than this space.

Thus, in a state that the additional weight 12 is placed between the rear part of the vehicle body frame 11 and the engine 14, a predetermined space is formed so as not to contact the engine 14 with the additional weight 12 due to vibration or the like even when the engine 14 is operated. Therefore, a space between the rear part of the vehicle body frame 11 and the engine 14 can be effectively used, and heat radiation at the time of operating the engine 14 can be ensured.

Further, in a state that the additional weight 12 is attached at an internal of the vehicle body frame 11, a height of the upper end of the vertical part 12*b* is made to be approximately the same height as that of the rear part of the vehicle body frame 11. More particularly, the recessed part 11*b* having a substantially U-shaped when viewed from a rear face is formed at the rear part of the vehicle body frame 11 to enable maintenance of the engine 14. The recessed part 11*b* is covered with a bonnet. The height of a lower end of the recessed part 11*b* is substantially agreed with the height of an upper end of the vertical part 12*b*.

Thus, in the rear part of the vehicle body frame 11, a space except a space occupied with the equipments such as the engine 14, the hydraulic oil tank, and a radiator can be used as a space for placing the additional weight 12. Therefore, when the working machine is enlarged, the space can be effectively used. Thus, by placing the additional weight 12 in the space between the engine 14 and the vehicle body frame 11, a configuration, in which the backward "protrusion" of the upper rotation body 10 can be made minimum, can be achieved. That is, due to the weight is applied in the space other than the space occupied with the equipments in the rear part of the upper rotation body 10, it is not necessary that the additional weight 12 is placed at the rear end of the upper rotation body 10.

For example, there is a power shovel having a configuration in which a counterweight is integrated with a vehicle body frame. However, a power shovel can equipped with a working machine having a longer boom and arm than the standard size (generally it is called a long front or a high lift front) even though an engine output or a vehicle body frame of the power shovel is the same. The long front is employed for expanding an operating radius or excavating a deeper position, and the high lift front is employed for reaching a position higher than usual.

In a case of a model having a long working machine even when having a same vehicle body frame or the engine output, it is necessary to place a heavier additional weight than that of a standard machine. Conventionally, a vehicle body frame integrated with an additional weight cannot have been co-used with the long front or the high lift front.

In this example, the vehicle body frame 11 can be co-used with the standard machine, the long front, or the high lift front, and a model can be developed only by changing the weight of the additional weight 12. For example, an additional weight of the long front or the high lift front can be added by adding as a different part the weight to a counterweight of a standard machine.

FIG. 5 is a perspective view to illustrate a bottom part of the vehicle body frame 11 illustrated in FIG. 4, so that the bottom part thereof is understood. The vehicle body frame 11 has an opening part 18, and the additional weight can be confirmed from an external. Further, the additional weight 12 has the opening part 15, and the oil pan 19 of the engine 14 can be confirmed.

The oil pan 19 is attached to a lower part of a crank case (not illustrated) of the engine 14, and is a portion covering the crank case. The oil pan 19 stores engine oil supplied into an engine by various oil supplying method to lubricate the engine. Therefore, it is necessary to exchange engine oil in the oil pan 19 as a maintenance work.

The present embodiment has a configuration in which the additional weight 12 is placed in a space between the engine 14 and the vehicle body frame 11. However, the opening part 15 can be provided so as to be able to confirm the oil pan 19 from outside. Thus, the engine 14 or the additional weight 12 is not necessarily removed at the time of the maintenance work, and thus engine oil can be easily exchanged.

Further, when the engine 14 is mounted on the additional weight 12, the oil pan 19 can be fit-mounted to the opening part 15. Thus, the height of the engine 14 can be low. In the power shovel 50 in which the driver seat 33 is mounted above the engine 14, a height of the driver seat 33 can be low, and thus the stability of the driver seat 33 can be ensured.

The present embodiment has a configuration in which the additional weight 12 is placed in a space between the engine 14 and the vehicle body frame 11 in the power shovel 50. Thus, this example can realize a configuration of a rear super-small pivoting radius type and the configuration can correspond to the long front or the high lift front. The present invention is not limited to the power shovel 50, and can be applied to other excavation machines having a working machine.

INDUSTRIAL APPLICABILITY

An example of practical use of the present invention is an excavation machine.

What is claimed is:

1. An excavation machine comprising:

an upper rotation body having a lower part, wherein the lower part comprises a front end and a rear end;

a vehicle body frame extending from the front end to the rear end of the lower part of the upper rotation body, the vehicle body frame comprising:

a floor part having an inner face;

a rear part having an inner face; and a counterweight formed at the rear part;

an engine mounted to have a space from the inner face of the floor art of the vehicle body frame and from the inner face of the rear part of the vehicle body frame; and an additional weight, which is formed in an L-shape in side view with a vertical part and a horizontal part, wherein the additional weight is placed at the horizontal part thereof in the space between the engine and the inner face of the floor art of the vehicle body frame, and is placed at the vertical part thereof in the space between the engine and the inner face of the rear part of the vehicle body frame.

2. The excavation machine according to claim 1, wherein the additional weight is formed with an opening part for inserting an oil pan provided at a lower part of the engine formed at a center of the horizontal part.

3. The excavation machine according to claim 1, wherein the additional weight is provided with cutouts at both sides of a front part of the horizontal part thereof for avoiding an engine mount provided on and projecting from the vehicle body frame.

* * * * *